United States Patent [19]

Schroeder

[11] Patent Number: 4,479,279

[45] Date of Patent: Oct. 30, 1984

[54] BRUSH FOR AUTOMATIC BRUSH CLEANING APPARATUS

[75] Inventor: Robert W. Schroeder, Bensenville, Ill.

[73] Assignee: RoMark Technology, Inc., Itasca, Ill.

[21] Appl. No.: 524,858

[22] Filed: Aug. 19, 1983

Related U.S. Application Data

[62] Division of Ser. No. 341,272, Jan. 21, 1982, Pat. No. 4,403,364.

[51] Int. Cl.[3] ..... A46B 15/00; A46B 17/00

[52] U.S. Cl. ..... 15/159 R; 15/246; 248/110

[58] Field of Search ..... 15/159 R, 176, 186, 15/187, 188, 38, 39, 146, 246; 211/65, 66; 248/110, 111, , 112, 113, 359–362

[56] References Cited

U.S. PATENT DOCUMENTS

| | | | |
|---|---|---|---|
| 622,621 | 4/1899 | Ham | 15/145 |
| 2,988,768 | 6/1961 | Hill | 248/110 X |
| 3,982,296 | 9/1976 | Russo | 15/39 X |

FOREIGN PATENT DOCUMENTS

| | | | |
|---|---|---|---|
| 190899 | 7/1957 | Austria | 15/176 |
| 5948 | of 1895 | United Kingdom | 15/176 |

*Primary Examiner*—Peter Feldman

*Attorney, Agent, or Firm*—Leydig, Voit, Osann, Mayer & Holt, Ltd.

[57] ABSTRACT

A brush for use in an automatic brush cleaning apparatus having a carrier member adapted to releasably receive, support, and transport the brush through sequential cleaning stations. The brush includes a rigid back, a plurality of bristles projecting outwardly from one side of the back, and an elongated support block rigidly fixed to the other side of the back. The support block is formed with a longitudinal aperture having a non-circular cross sectional shape for receiving a generally complimentary shaped carrier member of the automatic apparatus such that upon positioning of the carrier member through the aperture the brush is supported in predetermined relation thereto and can be transported without relative rotational slippage.

3 Claims, 14 Drawing Figures

BRUSH FOR AUTOMATIC BRUSH CLEANING APPARATUS

RELATED APPLICATION

This application is a division of U.S. patent application Ser. No. 341,272 filed Jan. 21, 1982, now U.S. Pat. No. 4,403,364

BACKGROUND OF THE INVENTION

The present invention relates to apparatus for cleaning brushes such as hair brushes and particularly to such an apparatus as might be used by professional hair stylists, beauticians and barbers.

SUMMARY OF THE INVENTION

An object of the present invention is to provide a brush that is adapted for easy and reliable use in an automatic apparatus for removing foreign matter therefrom, such as, for example, loose hair and dirt from the brush bristles.

DETAILED DESCRIPTION OF THE PREFERRED EMBODIMENT

Figure 1:
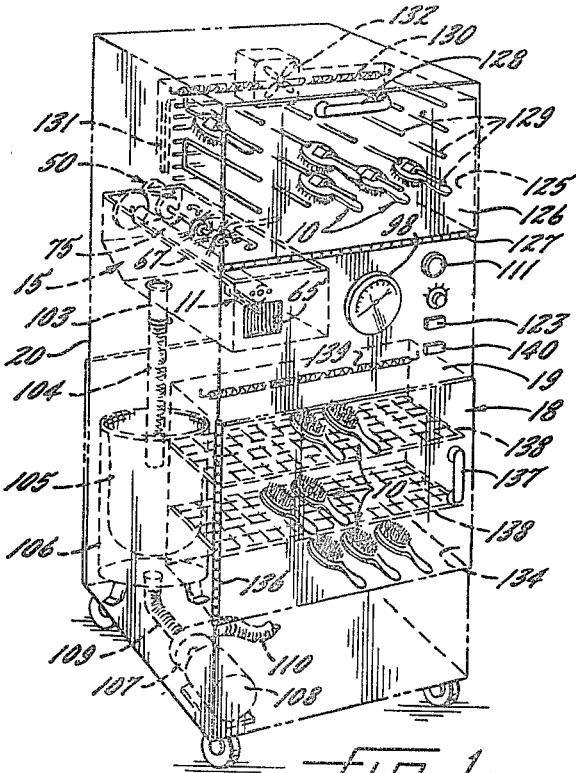
FIG. 1 is a perspective view of an automatic brush cleaning apparatus.

The present invention contemplates the provision of a novel apparatus for cleaning and sanitizing brushes, particularly hair brushes 10 and, in general, includes a carrier 11 which releasably supports a brush to be cleaned and presents the bristles 12 of the brush in a unique and effective manner to one or more cleaning devices. More specifically, the carrier moves along a predetermined path through a plurality of stations each having a cleaning device. A cam 13 extends along the path and co-acts with a follower 14 (FIG. 7) on the carrier to turn the latter arcuately about the line of travel and the cam is shaped to present the bristles of the brush 10 to the cleaning device at each of the stations. In addition, the cam also arcuately oscillates the carrier and hence the brush at least at one of the stations, and preferably at all of the stations, to effectively clean all the bristles of the brush.

In the form shown in the drawings, the carrier 11 and the cleaning devices are disposed within an elongated rectangular sheet metal box 15 which includes opposed front and rear end walls 16 and 17 and which is horizontally mounted in an upright cabinet 18 with the front and rear walls of the box being generally flush respectively with the front and rear walls 19 and 20 of the cabinet. The path of the carrier 11 is straight and extends from a position adjacent the front wall 16 to a position near the rear wall 17 and back. The cleaning devices include at least one nozzle which sprays a liquid on the bristles 12 of the brush 10, at least one power-rotated member with generally radially projecting fingers which engage the bristles, and another nozzle which subsequently sprays the bristles again. Herein, there are six aligned stations 21, 22, 23, 24, 25 and 26 (FIGS. 4 and 5) with nozzles 27 and 28 located at the first two stations 21 and 22, rotating members 29 and 30 at the next two stations 23 and 24 and nozzles 31 and 32 at the last two stations 25 and 26.

Drive mechanism is provided to move the carrier 11 back and forth between the front and rear end walls 16 and 17 of the box 15. Herein, this mechanism includes a horizontal screw 33 extending between the end walls and a nut 34 which is threaded on the screw and which is part of the carrier. As will be explained more in detail, the cam 13 and the follower 14 generally hold the nut from turning and, accordingly, the nut travels along the screw as the latter is rotated. The screw is formed with a forward thread 35 which drives the nut from the front end wall 16 to the rear end wall 17 and a return thread 36 which drives the nut in the reverse direction.

Figure 8:
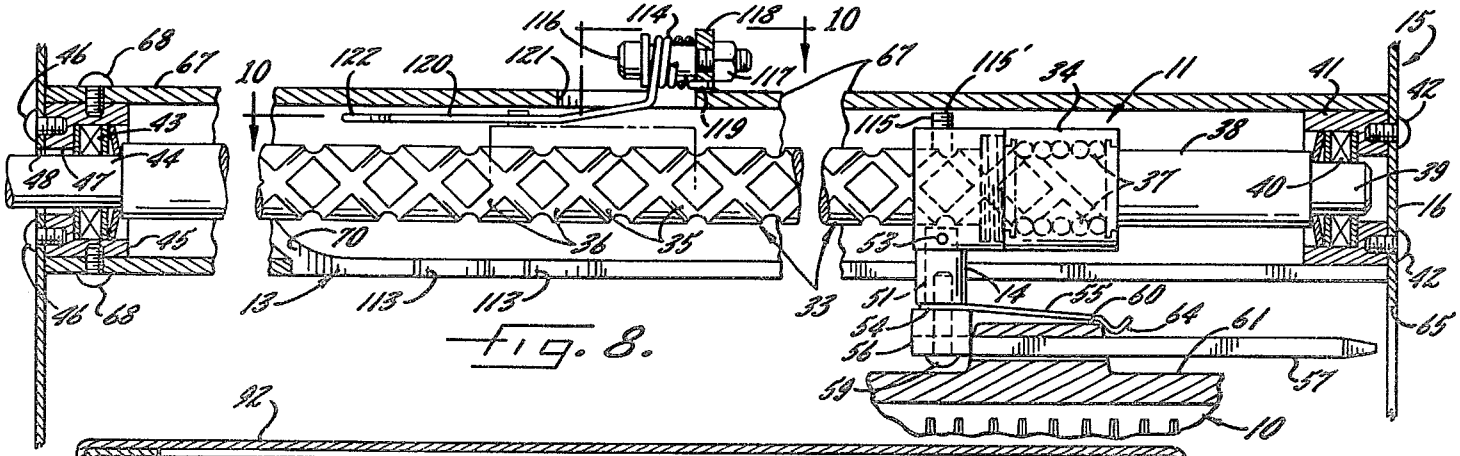
FIG. 8 is an enlarged sectional view taken along the line 8—8 in FIG. 5.

As shown in FIG. 8, the screw 33 and the nut 34 are a conventional ball screw and nut assembly with balls 37 (FIG. 8) which are captured within the nut and roll along either the thread 35 or the thread 36 which are in the form of grooves. The screw is fast on a shaft 38 with the forward end portion 39 of the shaft reduced and journaled in a bearing 40. The latter is mounted in a cylindrical plug 41 which is fastened to the front end wall 16 by the screws 42. At its rear end, the shaft 38 is reduced in cross section as indicated at 44 and is journaled in another bearing 43 mounted in a second cylindrical plug 45 which is fastened to the rear end wall 17 by screws 46. The end portion 44 projects through holes 47 and 48 in the plug 45 and the rear end wall where the shaft is driven by a motor 49 (FIG. 4) through a drive train 50.

To complete the carrier 11, a stub shaft 51 (FIGS. 7 and 8) received in a radial bore 52 in the periphery of the nut 34 projects radially outwardly from the nut and is pinned to the latter as indicated at 53. An end portion 54 of an elongated spring finger 55 abuts the underside of the stub shaft with the finger projecting horizontally toward the front end wall 16 of the box 15. A washer 56 abuts the underside of the finger end portion 54 and the end portion of a flat bar 57 is received in a recess 58 in the washing with the bar being disposed beneath and generally paralleling the spring finger. This assembly is held together by a screw 59 which projects through the bar, the washer and the spring end portion 54 and is threaded into the end of the stub shaft 51.

Figure 2:
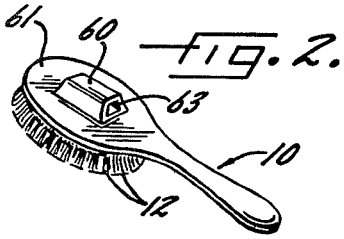
FIG. 2 is a perspective view of a brush embodying the invention made for use with the illustrated apparatus.
Figure 3:
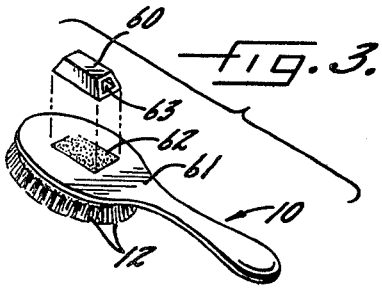
FIG. 3 is an exploded perspective view of a regular brush adapted for use with the apparatus.

In accordance with the invention, each brush includes means which permit easy cooperating engagement between the brush and carrier so as to permit the brush to be reliably supported and transported by the carrier through the operating stations of the cleaning apparatus. To this end, a block 60 is rigidly provided on the back 61 on the brush. The block 60 may either be integrally formed on the back, as shown in FIG. 2, or may be a separate part secured to the back by an adhesive 62, as illustrated in FIG. 3. The block 60, as clearly depicted in FIGS. 2 AND 3, has a length substantially less than the length of the back and is formed with a longitudinal aperture 63 which is of a size and shape generally complemental to the cross section of the bar 57 so that the block may be received on the bar which thereby supports the brush on the nut 34. As the block is slid onto the bar, the upper side of the block engages a downwardly projecting hook 64 on the free end of the spring finger 55 and resiliently cams the finger upwardly. When the down behind the block as shown in FIG. 8 to releasably hold the brush on the carrier. To permit the brush to be placed on and removed from the carrier when the latter is adjacent the front end wall 16, this wall is formed with a rectangular opening 65 (FIGS. 1 and 5) through which the brush may be moved into and out of the box 15. Flexible strips 66 may be attached to the wall 16 to hand down over the opening and prevent liquid from the cleaning nozzles from spraying out of the box while permitting the brush to pass through the opening, the box also having a removable cover 92.

Figure 7:
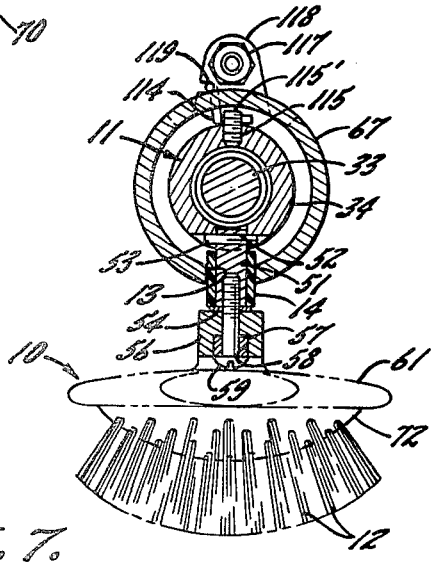
FIG. 7 is an enlarged sectional view taken along the line 7—7 in FIG. 5.

In the present instance, the cam 13 is a slot formed longitudinally in a sleeve 67 which encircles the screw 33 and the nut 34. The sleeve spans the end walls 16 and 17 of the box 15 and its ends are telescoped over the plugs 41 and 45 which support the sleeve. Screws 68 project through the end portions of the sleeve and are threaded into the plugs 41, 45 to prevent the sleeve from turning. As shown in FIGS. 7 and 8, the stub shaft 51 projects through the cam slot 13 and the cam follower 14 is a plastic sleeve which encircles the stub shaft and engages the sides of the slot. Thus, except for the limited turning of the nut 34 as permitted by the shape of the cam slot, the follower and the slot hold the nut against turning so that the nut travels along the screw 33 as the latter is rotated.

Figure 6:
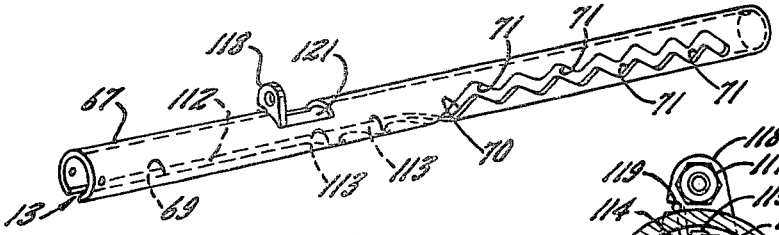
FIG. 6 is a perspective view of the cam used to control the motion of the brush during cleaning.

In the form of the invention illustrated in the drawings, the brush 10 initially is supported on the carrier 11 with the bristles 12 pointed down. The nozzles 27, 28, 31 and 32 and the cleaning members 29 and 30, however, are aligned horizontally along one side of the screw 33. Accordingly, the initial portion 69 of the cam slot is stright and opens downwardly. At the point where the brush approaches the first station 21, the follower 14 engages a ramp 70 (FIG. 6) in the cam slot and this turns the carrier. Because of the non-circular cross sections of the bar 57 and the hole 63, the brush turns through approximately 90 degrees so that the bristles face sidewise toward the nozzles and the cleaning members. Thereafter, the cam slot is formed with zigzag portions 71 which extend above and below the centerline of the screw 33 so that the carrier and the brush are oscillated up and down between an upper position as shown in solid lines in FIG. 9 and a lower position as illustrated in broken lines. These portions 71 of the slot are arranged so that there is at least one complete oscillation of the brush as it passes through each cleaning station. Thus, all of the bristles are presented to each nozzle and to each cleaning member even though the bristles may be supported by an arcuate underside 72 of the brush.

Figure 4:
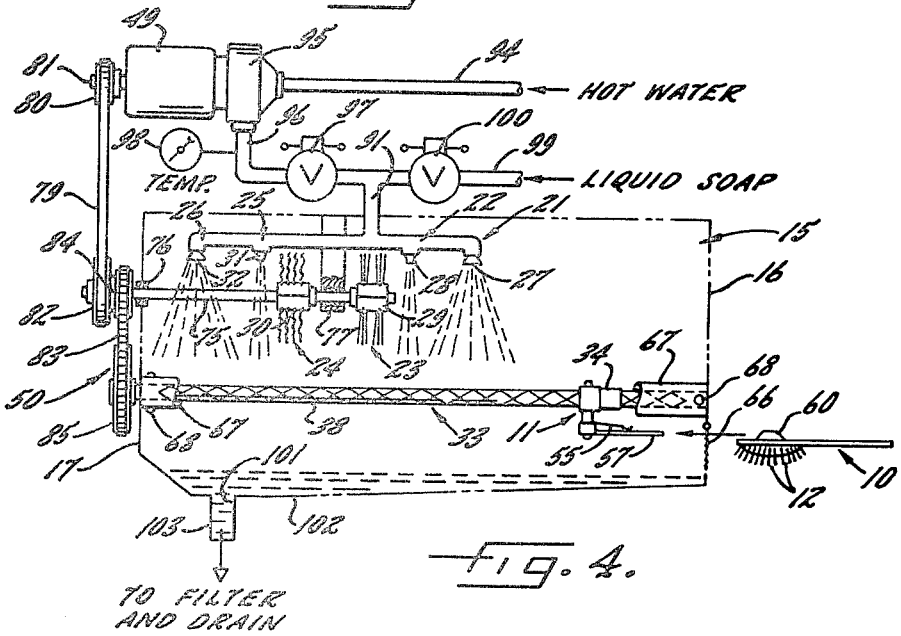
FIG. 4 is a schematic view of the brush cleaning apparatus.
Figure 5:
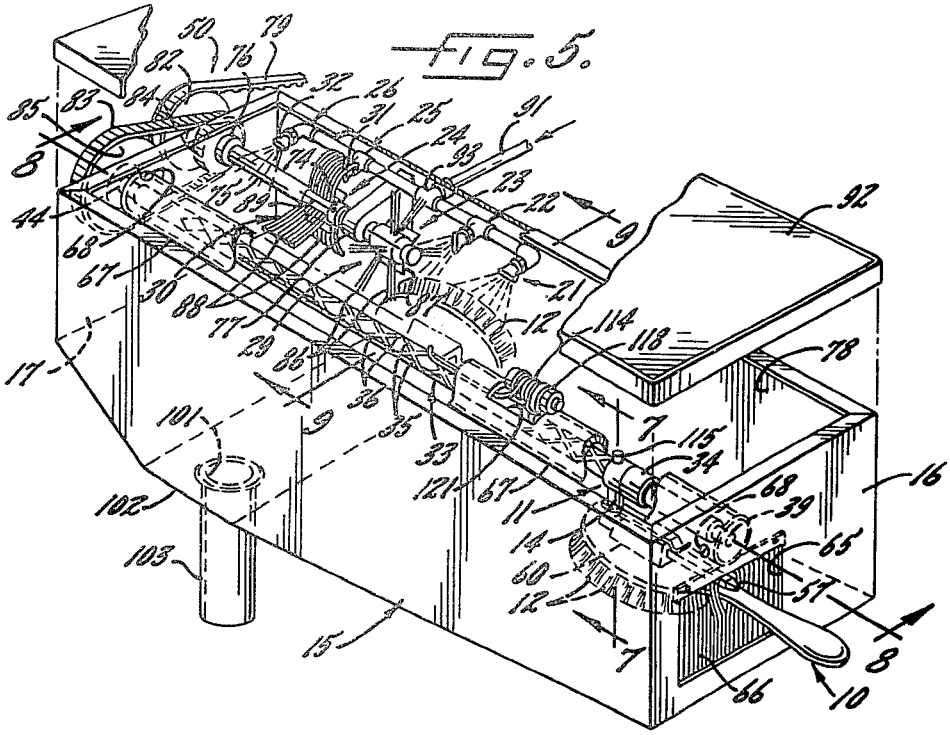
FIG. 5 is an enlarged fragmentary perspective view of the brush cleaning apparatus.

As shown in FIGS. 4 and 5, the rotating cleaning members 29 and 30 include hubs 73 and 74 respectively which are keyed to a horizontal shaft 75. This shaft parallels the screw 33 in the same general horizontal plane as the screw and is journaled in the box 15 by means of a bearing 76 in the rear end wall 17 and a bracket 77 secured to a side wall 78 of the box. The shaft 75 projects through the rear end wall so that it, like the screw, may be driven by the motor 49 through the drive train 50. Thus, the drive includes a gear belt 79 trained about a toothed pulley 80 on the motor shaft 81 and a second toothed pully 82 fast on the outer end of the shaft 75 so that the motor drives the shaft through the pulleys and the belt. The shaft 75 and the screw 33 are driven in synchronization but with the screw turning at a slower speed by an endless chain 83 which extends around a sprocket 84 on the shaft 75 and a larger sprocket 85 on the screw shaft 38.

Figure 9:
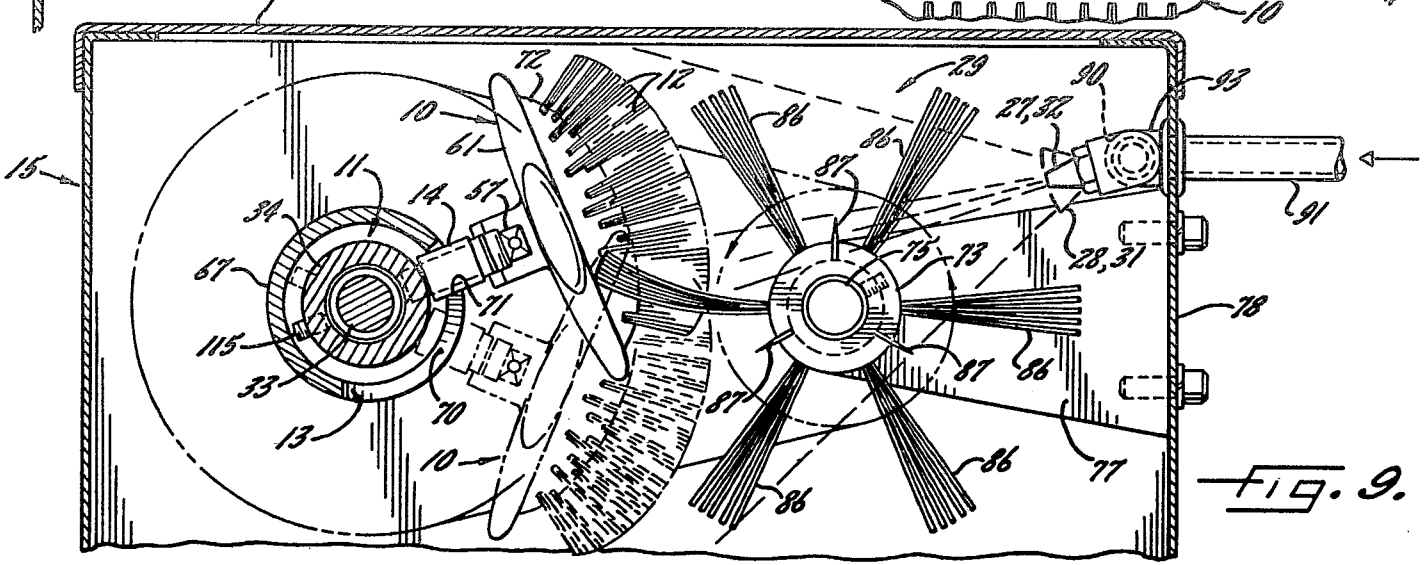
FIG. 9 is an enlarged fragmentary sectional view taken along the line 9—9 in FIG. 5.
Figure 10:
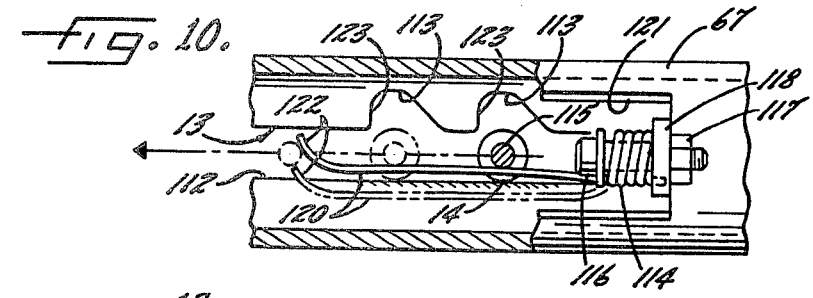
FIG. 10 is a fragmentary sectional view taken along the line 10—10 in FIG. 8.
Figure 11:
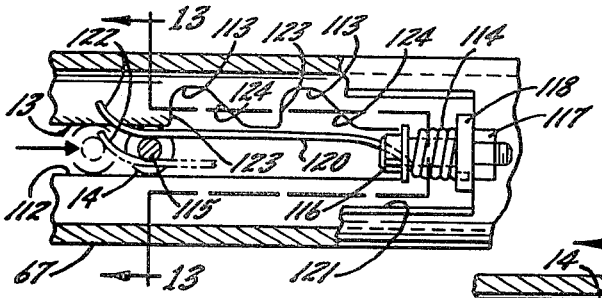
FIG. 11 is a sectional view similar to FIG. 10 but showing the parts in a moved position.
Figure 12:
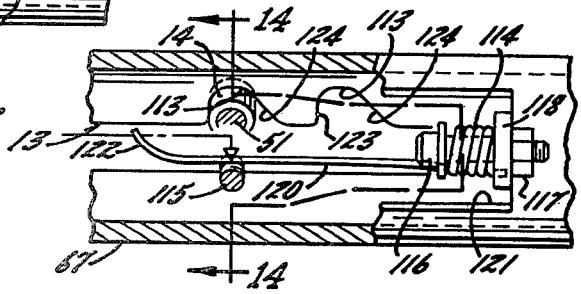
FIG. 12 is a fragmentary sectional view similar to FIG. 10 showing the parts in a still further moved position.

The fingers of the rotary cleaning member 29 herein are comparatively stiff wire bristles 86 projecting radially from the hub 73 and arranged in six groups equally spaced around the hub. As illustrated in FIG. 9, the bristles 86 are sufficiently long to project through the entire length of the bristles 12 of the brush 10 and to flex against the brush bottom 72. Thus, the wire bristles remove hair entrained in the brush bristles or at least bring the hair to the outer ends of the brush bristles. In order that the matting of the hair as it is removed does not impede the effectiveness of the wire bristles, the cleaning member 29 also includes a plurality of knife blades 87 which are mounted on the hub 73 and cut the matted hair. Herein, there are three such blades equally spaced around the hub and anchored in the latter with the blades projecting radially from the hub and extending longitudinally of the shaft 75.

In the present instance, the fingers of the second rotary cleaning member 30 are intended primarily to remove hair left on the ends of the bristles 12 of the brush 10 by the cleaning member 29 and, to this end, the fingers on the member 30 are flat strips 88 of a flexible material such as rubber or the like. The strips are arranged in three groups equally spaced angularly around the hub 74 of the member 30 with the inner ends of the strips anchored in the hub. The strips are long enough that their free end portions flap against the ends of the brush bristles 12 to remove lossened hair therefrom. If desired, the member 30 may include knife blades 89 similar to the blades 87 to cut up matted hair being removed by the strips.

The four nozzles 27, 28, 31 and 32 are mounted on and communicate with the interior of a horizontal manifold pipe 90 (FIGS. 4 and 5) which is disposed behind and slightly above the shaft 75 and parallels the latter. An inlet pipe 91 projecting through and mounted on the side wall 78 of the box 15 is connected by a T-joint 93 to the manifold pipe to support the latter and to supply liquid to the nozzles through the manifold pipe. Hot water is drawn from a suitable source (not shown) through a pipe 94 by a pump 95, which is driven by the motor 49, and the water is delivered to the inlet pipe 91 from the pump through a pipe 96 which is controlled by a solenoid-operated valve 97, the temperature of the water being visually shown by an indicator 98 which communicates with the pipe 96 and is mounted on the front wall 19 of the cabinet 18 (see FIG. 1). In order to sanitize the brushes, the temperature of the water should be at least 180° Fahrenheit, and preferrably suitable controls are provided to prevent cycling of the machine when the water temperature is below such temperature. Liquid soap from a suitable source (not shown) also is delivered to the inlet pipe 91 and hence to the nozzles through a pipe 99 which is connected to the inlet pipe and is controlled by a second solenoid-operated valve 100. In the present instance, the soap is concentrated and includes a disinfectant and the soap is mixed with water from the pipe 96 with the water drawing the soap into the pipe 91 by a jet pumping action, the ratio of water to soap concentrate being on the order of twenty to one. In other words, water is delivered to the nozzles when the valve 97 is open and the valve 100 is closed and soap is delivered to the nozzles when both valves are open. Thus, by selectively controlling the valves 97 and 100, soap or hot rinse water may be sprayed through the nozzles.

As shown in FIGS. 4 and 5, the nozzles 27 and 32 are shaped to spray liquid in a generally horizontal plane and the nozzles 28 and 31 are shaped to spray in a generally vertical plane so that a brush 10 being cleaned is sprayed vertically and horizontally both before and after it is engaged by the rotary cleaning members 29 and 30. After being sprayed on the brush, the liquid from the nozzles, together with hair removed from the brush 10, drains through a hole 101 in the bottom wall 102 (FIG. 5) of the box 15 and a rigid tube 103 secured to the bottom wall. A flexible tube 104 (FIG. 1) is attached to the tube 103 and leads to the filter bag 105 removably supported in a drum 106 so that the hair is collected in the bag while the liquid filters through the bag to the bottom of the drum, the drum being mounted in the cabinet 18 beneath the box 15. A pump 107 mounted in the bottom of the cabinet and driven by a motor 108 draws the filtered liquid out of the drum through a hose 109 and delivers the liquid to a drain through a hole 110.

The drive motor 49 and the solenoids of the valves 97 and 100 are operated by means of any suitable control circuit through a cycle in which the brush 10 moves from the position adjacent the front end wall 16 of the box 15 as shown in FIG. 5 to the rear end wall 17 and back to the starting position, each cycle being initiated by manually pressing a button 111 (FIG. 1) or the front wall 19 of the cabinet. In a typical cycle, the brush 10 is turned through 90 degrees during the beginning of its forward travel and then is sprayed with a solution of liquid soap and water at a temperature of 180° F. by the nozzles 27 and 28, the valves 97 and 100 being open. Next, the bristles 12 of the brush are engaged successively by the bristles 86 of the rotary member 29 and by the strips 88 of the rotary member 30 and then the brush bristles are sprayed again with soap solution by the nozzles 31 and 32. It will be appreciated that any long or matter hair which is removed from a passing brush by the bristles 86 and strips 88 and which tends to wrap around the rotating members upon which the bristles and blades are mounted will be severed by the respective blades 87 and 89. As the brush begins its return travel, the valve 100 is closed and the valve 97 remains open so that the nozzles 31 and 32 rinse the bristles 12 with hot water. The brush bristles next are engaged again by the rotary members 29 and 30 and then are given a final rinse of hot water by the nozzles 27 and 28.

Figure 13:
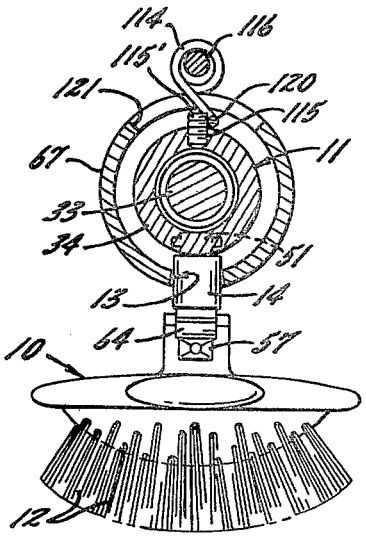
FIG. 13 is a sectional view taken along the line 13—13 in FIG. 11.
Figure 14:
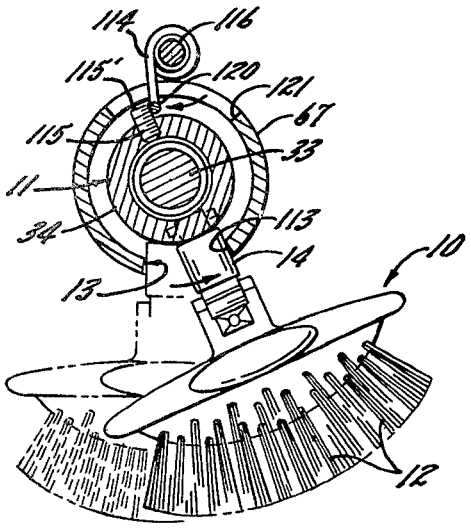
FIG. 14 is a sectional view taken along the line 14—14 in FIG. 12.

In the final portion of the return travel of the brush 10, the latter is oscillated rather vigorously to shake excess water from the bristles 12 and, preferably, this is done with the bristles facing downwardly. The cam slot 13 and follower 14 are used to effect this action and, for this purpose, the portion of the slot between the initial straight portion 69 and the ramp 70 has one side 112 straight (FIGS. 6, 10, 11 and 12) and the other side is formed with a plurality of notches 113, herein two in number. Means is provided to hold the follower against the straight side 112 on the forward travel of the brush and to cause the follower to enter the notches 113 on the return travel whereby the notches produce the shaking action. Herein, this means comprises a torsion spring 114 which is mounted on the sleeve 67 and engages the projecting end portion 115' of a screw 115 (FIGS. 7, 13 and 14) threaded into the nut 34 diametrically opposite the stub shaft 51.

More specifically, the torsion spring 114 is wound around a pin 116 (FIG. 8) which parallels the screw 33 and is clamped by a nut 117 to an ear 118 struck up from the upper side of the cam sleeve 67, the pin projecting from the ear in the direction of the forward movement of the nut 34. One end 119 of the spring is anchored in the ear and the other or free end portion 120 of the spring extends down through an opening 121 in the sleeve and projects along the screw toward the rear end wall 17 of the box 15. During the forward travel of the nut, the free end portion 120 of the spring is in its relaxed position as shown in full lines in FIG. 10 and the screw 115 passes to the right of this end portion as viewed in FIG. 7 as the follower 14 passes the notches 113 so that the spring resiliently prevents the nut from turning in a direction which would cause the follower to enter the notches. Once the follower has passed the notches, the screw 115 engages the curved end 122 of the spring and moves the spring to one side as shown in broken lines in FIG. 10 so that the pin passes the spring end portion 120 with the nut 34 travelling in a straight line.

As soon as the screw 115 passes the curved spring end 122, the free end portion 120 of the spring 114 returns to its relaxed position. As a result, on the return travel of the nut 34 the screw 115 engages the curved end and causes the spring to flex so that the screw passes along the other or left side of the end portion 120 as viewed in FIG. 13 (see also FIG. 11). This urges the nut to turn in the direction in which the follower 14 bears against the notched edge of the cam slot 13. As a result, the follower is successively moved into each of the notches 113 and, as the follower enters and leaves each notch, the brush 10 is swung to the side as shown by full lines in FIG. 14 (see also FIG. 12) and then returned to its downwardly facing position illustrated in broken lines. The entering edge 123 of each notch is generally circumferential of the sleeve 67 with the result that the follower enters each notch abruptly resulting in a vigorous shaking of the brush. To avoid the possibility of jamming, the leading edges 124 of the notches are inclined so that the follower is gradually cammed out of each notch.

The cabinet 18 includes a chamber 124 (FIG. 1) above the box 15 for drying cleaned brushes 10 and access to this chamber is obtained by opening a door 126 on the front of the cabinet, the door being horizintally hinged along its lower edge to the cabinet as indicated at 127 and being provided with a suitable handle 128. A plurality of horizontal rods 129 project forwardly from the rear of the cabinet and receive the holes 63 in the blocks 60 on the backs of the brushes to support the latter. An ultraviolet lamp 130 for further sanitizing the brushes extends across the top of the chamber and the air within the chamber is heated by electric heating elements 131 in the back of the chamber and circulated by an electric fan 132, the lamp, the heating elements and the fan being controlled through a suitable circuit (not shown) by a push button 133 on the front of the cabinet. The cabinet also provided with a storage chamber 134 below the box 15 and access to this chamber is achieved by opening a second door 135 which is supported on the cabinet along one side edge by a vertical hinge 136 and is provided with a handle 137. The brushes 10 are supported on racks 138 in the chamber 134 with the bristles 12 facing up and the bristles are subjected to the rays of a second sanitizing ultraviolet lamp 139 extending across the top of this chamber, this lamp being turned on and off by a switch button 140 on the front of the cabinet. The brushes stored in such compartment are maintained in a sanitized condition until reuse.

With the apparatus described above, a brush 10 is inserted through the opening 65 and slipped onto the rod 64 of the carrier 11 where it is held by the spring finger 55. A cleaning cycle is initiated by pressing the button 111 which energizes the various components of the apparatus. This turns the screw 33 to cause the nut 34 and hence the brush 10 to travel toward the rear end wall 17 of the box 15 and back to the starting position. At the same time, the shaft 75 is driven to turn the rotary cleaning member 29 and 30 and the valves 97 and 100 are sequentially oiperated to selectively spray either a soap and hot water solution or hot water through the nozzles 27, 28, 31 and 32. As the brush approaches the nozzle 27, the cam 13 turns the carrier so that the bristles 12 of the brush face the nozzles and the cleaning members and, thereafter, the cam oscillates the brush as it passes the nozzles and the cleaning members on both the forward and return travel of the carrier so that the brush bristler are thoroughly cleaned of loose hair and other foreign matter. Near the final portion of the return travel of the nut 34, the follower 14 enters the notches 113 in the cam slot 13 to vigorously oscillate the brush and shake excess water from the bristles. The cycle is complete when the carrier comes to rest at its original position at which time the cleaned brush is removed from the box 15 through the opening 65. It has been found that an effective cleaning cycle requires less than 15 seconds and, obviously, very little time is used in loading and unloading the brushes. Cleaned and sanitized brushes are hung on the rods 129 in the chamber 125 to dry and, thereafter, they are removed from the chamber 125 and stored on the racks 138 in the chamber 134.

I hereby claim:

1. A brush for use in an automatic brush cleaning apparatus having a carrier member adapted to releasably receive, support, and transport the brush through sequential cleaning stations, said brush comprising a rigid back, a plurality of bristles projecting outwardly from one side of said back, an elongated support block rigid with the other side of said back, said block having a length substantially less than the length of said back and being formed with an aperture extending longitudinally through said block, and said aperature having a non-circular cross section for removably receiving a complementally shaped carrier member of the automatic apparatus for enabling said brush to be supported in predetermined relation to the carrier member as an incident to positioning of said carrier member into said aperture and be transported by the carrier member without relative rotational slippage therebetween.

2. The brush as defined in claim 1 in which said block is formed integrally with said back.

3. The brush as defined in claim 1 in which said block is adhesively secured to said back.

* * * * *